US005723805A

United States Patent [19]

Lacombe

[11] Patent Number: 5,723,805

[45] Date of Patent: Mar. 3, 1998

[54] VIBRATION TRANSDUCER DEVICE FOR STRINGED MUSICAL INSTRUMENTS

[76] Inventor: Robert J. Lacombe, 1825, McNeil, Ville Ste-Catherine, PQ, Canada, J0L 1E0

[21] Appl. No.: 679,235

[22] Filed: Jul. 12, 1996

[51] Int. Cl.[6] ..... G10H 3/18

[52] U.S. Cl. ..... 84/727

[58] Field of Search ..... 84/726–728

[56] References Cited

U.S. PATENT DOCUMENTS

| | | | |
|---|---|---|---|
| 2,239,985 | 4/1941 | Benioff . | |
| 2,573,254 | 10/1951 | Fender . | |
| 3,297,813 | 1/1967 | Cookerly et al. . | |
| 3,325,579 | 6/1967 | Cookerly et al. . | |
| 4,069,732 | 1/1978 | Moskowitz et al. . | |
| 4,472,994 | 9/1984 | Armstrong . | |
| 4,499,809 | 2/1985 | Clevinger | 84/726 |
| 4,941,388 | 7/1990 | Hoover et al. | 84/726 |
| 5,292,999 | 3/1994 | Tumura | 84/728 |

*Primary Examiner*—Stanley J. Witkowski

*Attorney, Agent, or Firm*—Goudreau Gage Dubuc & Martineau Walker

[57] ABSTRACT

A vibration transducer device for stringed musical instrument comprising a magnetic field generating bar, metal strings of the musical instrument and an electronic circuit is described herein. The electronic circuit amplifies a minute electric voltage induced in the metallic strings by the magnetic field when the metallic strings are vibrating.

16 Claims, 6 Drawing Sheets

VIBRATION TRANSDUCER DEVICE FOR STRINGED MUSICAL INSTRUMENTS

FIELD OF THE INVENTION

The present invention relates to vibration transducer devices. More specifically, the present invention relates to a device for sensing and transducing the vibrations of metallic strings of musical instruments to allow the electrical amplification of these vibrations.

BRIEF DESCRIPTION OF THE PRIOR ART

Two methods are known for sensing and transducing the vibrations of metallic strings of a stringed musical instrument into electrical signals that are thereafter amplified into audible wave through an electronic power amplifier circuit feeding at least one loudspeaker.

The first method for sensing and transducing metallic string vibrations is an indirect, or proximity, method in which the metallic strings of the musical instrument vibrate in a direction which is essentially perpendicular to a magnetic field, formed by magnetic flux lines, generated by permanent magnets of an electromagnetic pickup. The vibrating strings therefore cause perturbations within the field of magnetic flux lines, which, in turn, cause electrical signals to be induced in a coil or plurality of coils provided in the electromagnetic pickup. These electrical signals may then be supplied to a power amplifier circuit, external to the musical instrument, for subsequent electronic amplification to thereby produce audible sound through a loudspeaker. The mechanical vibrations of the strings are thereby transduced into audible sounds.

Most of the contemporary "electrified" stringed musical instruments, such as the modern electric guitar, are using transducing devices (usually called pickups) designed according to the above described indirect sensing method. One commonly used pickup is described in U.S. Pat. No. 2,573,254 issued on Oct. 30, 1951 to Clarence L. Fender, entitled "Combination bridge and pickup assembly for string instruments". The pickup described in this document comprises a permanent magnet surrounded by a coil, which is connectable to an amplifier. The principle of operation is similar to the indirect method described hereinabove: the vibration of each string causes a disturbance in the magnetic field of the associated magnets. This disturbance has the effect of generating an electric voltage in the conductive coil, which voltage is supplied to an external power amplification circuit to be amplified and then directed to a loudspeaker.

A major drawback of the pickups using the indirect method of vibration sensing and transducing is that the amplified sound is not the signal as it comes out of the string but the signal that comes out of a coil that surrounds the source of magnetic field. Consequently, the resulting audible sound is affected by the number of turns of the coil, the size of the electrical wire used to form the coil, the number and the position of the electromagnets, the distance between the magnet or electromagnet and the string, the nature, composition and size of the magnet, amongst others. Therefore, the design and construction of these pickups requires elaborated techniques and devices to control and correct these parameters.

Yet another drawback of this type of pickup is the magnetic pulling effect caused by the proximity of the permanent magnets from the strings. Indeed, the strings, being metallic, are affected by the close proximity of the magnetic fields created by the magnets of the pickups, which are placed directly under the strings, thereby modifying their vibratory characteristics. Indeed, the metallic strings may not vibrate normally thus inhibiting the reproduction of all harmonics which normally add to and subtract from each other. This phenomenon of harmonics "beating" is evident and heard when playing an acoustical string instrument. This is believed to be one of the reasons electric guitars provided with transducing devices using the indirect method delivers a different sound having so called "electric" characteristics.

The second or direct method for sensing and transducing metallic string vibrations consists of inducing, in an electrically conductive string such as steel or other metal string of a musical instrument, an electric signal by placing the string in a magnetic field generated by a magnet and by causing the string to vibrate. Indeed, when the string crosses the magnetic field, a minute electric signal is induced in the string itself. This electric signal may then be directly amplified into audible sound by a power amplifier circuit.

The direct method of transforming the string vibrations into sound wave and a device utilizing that method are described in U.S. Pat. No. 2,239,985 issued on Apr. 29, 1941 to Hugo Benioff and entitled "Electrical musical instrument". This document describes a transducing devices used on a violin to amplify the vibrational energy of the strings electrically. The working principle defined in this document is that the cutting of magnetic flux lines by the vibrating string generates an electromotive force in the string, which is proportional to the product of field strength, string velocity and length of the string in the field. This electromotive force is supplied to an amplifier whose output is reproduced by a suitable loud speaker.

One drawback of the device described by Benioff is that the magnet used to generate the magnetic flux lines is placed directly under the metallic strings which results in a magnetic pulling effect on the stings and prevent their natural vibrations as described hereinabove. Furthermore, since the level of amplification by the amplification circuit is great, small interferences are also amplified. The resulting audible sound produced by the suitable speaker is therefore a combination of the signal coming from the string and from the interferences, which is undesirable.

U.S. Pat. No. 3,325,579 issued to Cookerly on Jun. 13, 1967 and U.S. Pat. No. 4,069,732 issued to Moskowitz et al. on Jan. 24, 1978 both describe electrical stringed instruments having transducers which work under the second direct transducing method described hereinabove. The magnets used to generate the magnetic flux lines are both somewhat U-shaped and generate magnetic flux lines which are essentially parallel to a plane including the strings of the musical instrument. This approach is an improvement over Benloft since there is no downward magnetic pulling of the metallic strings towards the body of the guitar. However, there is still a magnetic pulling of the strings towards one of the two poles of the magnet.

A drawback of this approach is that the U-shaped magnet, which has to be at least as long as the distance between the first and last string, is bulky and therefore relatively heavy. This increases the total weight of the musical instrument which is undesirable. Furthermore, is the user wants to change the direction of the magnetic flux lines with the device of Moskowitz, the heavy magnet has to be taken out of the instrument body and reinserted upside down, which is not very practical during a performance. This change of direction of magnetic flux lines is desirable since it may change the characteristics of the audible sound.

U.S. Pat. No. 3,297,813, issued to Cookerly on Jan. 10, 1967 describes a electric musical instrument having a transducer which works under the second direct transducing method described hereinabove and having 8 (eight) strips of magnet forming the fingerboard of the instrument to generate a magnetic field. One major drawback of the electric musical instrument described be Cookerly is the fact that it is not acceptable to make a fingerboard by joining strips of magnet since the fingerboards are usually made of hardwood which are wear resistant. Furthermore, the drawings of this patent do not clearly illustrate the positioning of the frets, which are conventionally made of a metallic material, on the fingerboard. These frets could be a major drawback since, by pressing more than one string on the same fret near the body of the guitar, the user would cause a short circuit allowing the signal from one string to be supplied to more than one preamplifier, thus making it impossible to set individual string volume. Also, the strings are subjected to the magnetic pull phenomenon discussed earlier.

OBJECTS OF THE PRESENT INVENTION

An object of the present invention is therefore to provide a vibration transducing device free of the drawbacks of the above mentioned transducing devices.

SUMMARY OF THE INVENTION

More specifically, in accordance with the present invention, there is provided a vibration transducer device for stringed musical instruments including a body and a predetermined number N of tensioned and electrically conductive longitudinal strings each having a first end and a second end; the tensioned longitudinal strings lying into a plane laterally adjacent to each other; the vibration transducer device comprising:

a magnetic field generating bar to be mounted to the body and including a series of N+I adjacent magnetic field generating means each having a magnetic pole for facing the plane when the bar is mounted to the body; each magnetic poles being of a given polarity; each pair of adjacent magnetic poles being of reverse polarities; the series of N+1 adjacent magnetic field generating means to be arranged in a staggered relationship with the N strings when the bar is mounted to the body;

an amplification circuit having a predetermined number N of amplification channels; each amplification channel to be electrically connected to the first and second ends of a corresponding one of the strings; each amplification channel amplifying an electric signal induced in the corresponding string by a magnetic field generated by the magnetic field generating bar, upon vibration of the corresponding string.

The staggered relationship between the means for generating a magnetic field and the strings allows the magnetic field generated to be substantially parallel to the plane defined by the strings in the proximity of the strings without increasing significantly the total weight of the musical instrument.

According to another aspect of the present invention, there is provided an electrical musical instrument comprising:

a body having an upper bout and a lower bout;

a longitudinal neck having a proximate end and a distal end; the proximate end being attached to the upper bout of the body;

a predetermined number N of tensioned and electrically conductive longitudinal strings each having a first end mounted to the lower bout of the body and a second end mounted to the distal end of the longitudinal neck; the strings lying into a plane laterally adjacent to each other;

a string vibration transducer device including:

a magnetic field generating bar mounted to the body and including a series of N+1 adjacent magnetic field generating means each having a magnetic pole for facing the plane; each magnetic poles being of a given polarity; each pair of adjacent magnetic poles being of reverse polarities; the series of N+1 magnetic field generating means being arranged in a staggered relationship with the N strings;

an amplification circuit mounted to the body; the amplification circuit having a predetermined number N of amplification channels; each amplification channel being electrically connected to the first and second ends of a corresponding one of the N strings; each amplification channel amplifying an electric signal induced in the corresponding string by a magnetic field generated by the magnetic field generating means upon vibration of the corresponding string; the amplification circuit having an output electrically connected to an output connector of the musical instrument.

According to yet another aspect of the present invention, there is provided a magnetic field generating bar for use in a vibration transducer device for stringed musical instrument having a predetermined number N of tensioned and electrically conductive longitudinal strings lying into a plane laterally adjacent to each other, the magnetic field generating bar comprising a series of N+1 adjacent magnetic field generating means each having a magnetic pole for facing the plane when the bar is mounted to the body; each magnetic poles being of a given polarity; each pair of adjacent magnetic poles being of reverse polarities; each pair of adjacent magnetic poles generating an arcuate magnetic field to be traversed by one of the N strings.

It is to be noted that in the present disclosure as well as in the appended claims, when the strings of the musical instrument are said to be lying into a plane, this expression is also meant to include the usual radius found on conventional fingerboards and followed by the metallic strings of stringed musical instruments.

The objects, advantages and other features of the present invention will become more apparent upon reading of the following non restrictive description of preferred embodiments thereof, given by way of example only with reference to the accompanying drawings.

BRIEF DESCRIPTION OF THE DRAWINGS

The present invention will be described in detail with reference to the accompanying drawings, in which.

DETAILED DESCRIPTION OF PREFERRED EMBODIMENTS

It has been found that known concepts of generation of electricity could be used to transform the vibrations of an electrically conductive material, such as a metallic string, into an electrical signal or voltage. Indeed, when such a string vibrates in the proximity of a magnetic field, a voltage is induced in the metallic string. The amplitude of this voltage varies with the intensity of the magnetic field and the frequency of vibration of the metallic string. Therefore, by amplifying the amplitude of the electric signal induced in the metallic string by the magnetic field, the electric signal can be supplied to a conventional musical instrument power amplifier for further amplification.

Referring now to the appended drawings, a preferred embodiment of the present invention will be described.

Figure 1:
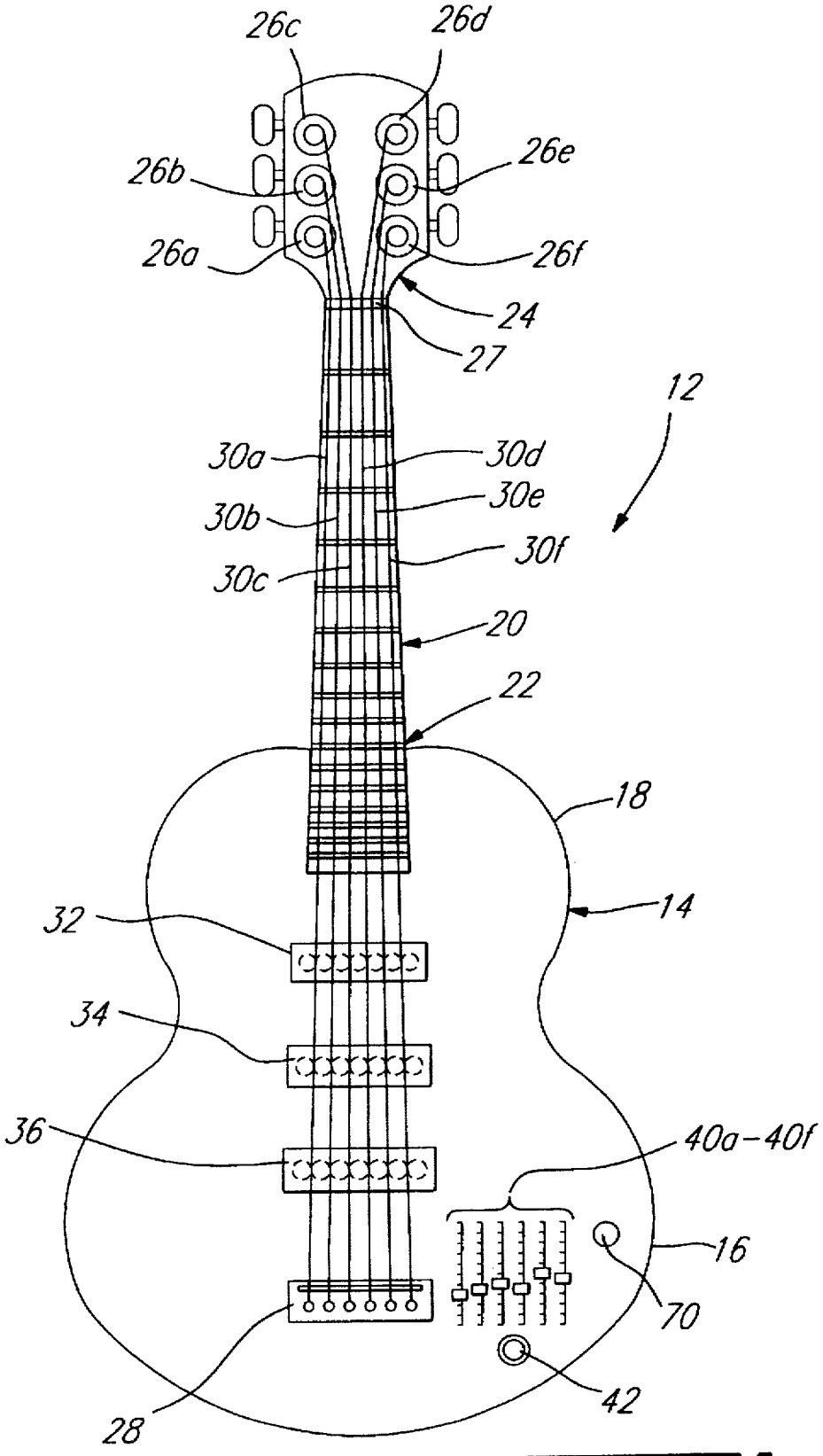
FIG. 1 is a front elevational view of an electric guitar incorporating a vibration transducing device according to an embodiment of the present invention.

FIG. 1 illustrates a front elevational view of an electric guitar 12 including a body 14 having a lower bout 16 and an upper bout 18, a neck 20 having a proximate end 22 mounted to the upper bout 18 and a distal end 24 having six tuning keys 26*a*–26*f* and a nut 27. The lower bout 16 is provided with a bridge 28. The electric guitar 12 also includes six metallic strings 30*a*–30*f* which are tensioned between the bridge 28 and the tuning keys 26*a*–26*f*.

The electric guitar 12 further includes a strings vibration transducer device including three magnetic field generating bars 32, 34 and 36, an electronic circuit 38 (FIG. 2) including controls 40, 70 and an output jack 42. The electronic circuit 38 is powered by a suitable power source, for example a conventional nine volts battery (now shown).

Figure 2:
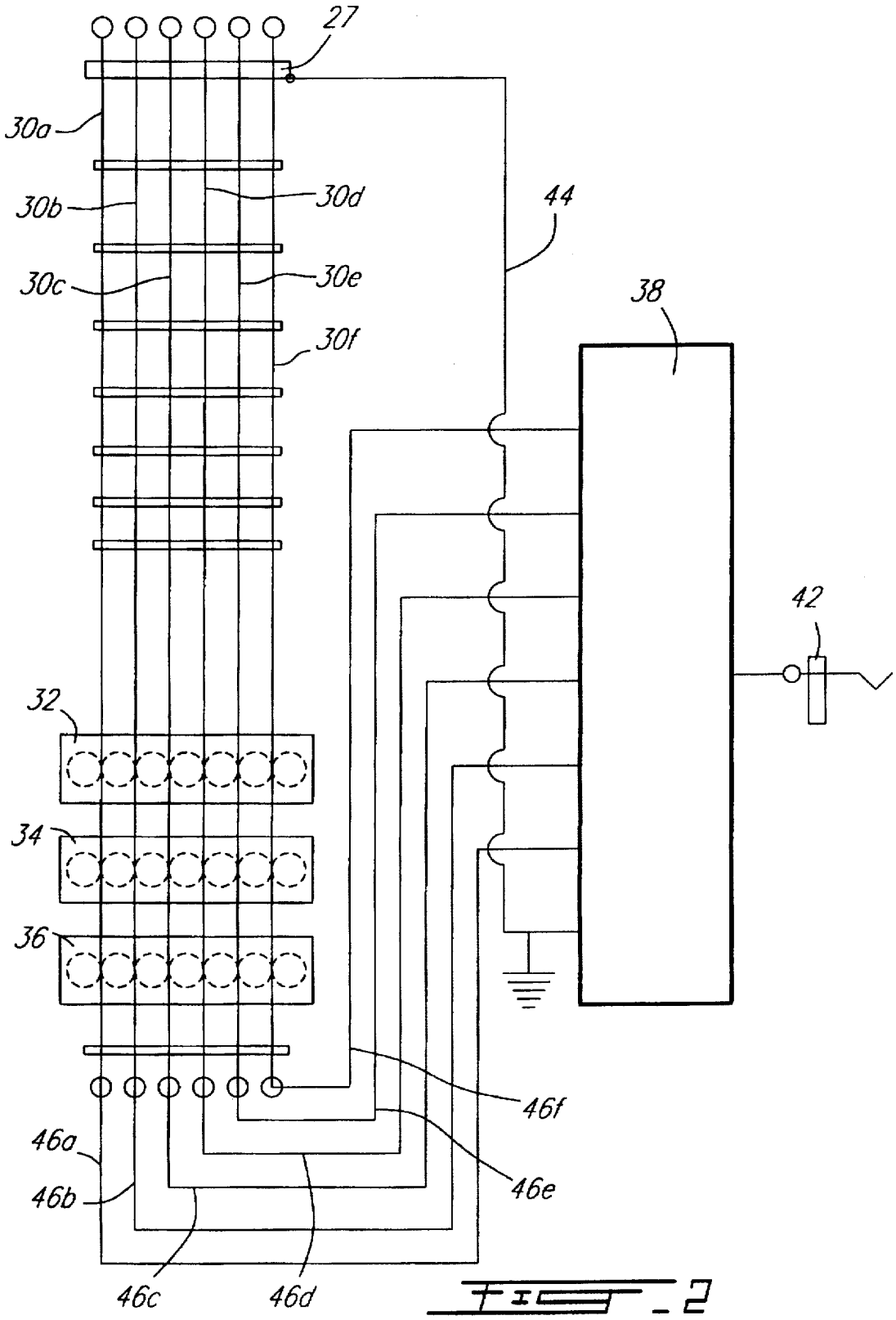
FIG. 2 is a schematic view of a portion of an electric guitar incorporating a vibration transducing device according to an embodiment of the present invention.

Turning now to FIG. 2 of the appended drawings, the connections between the various elements of the vibration transducing device will be described. The nut 27 is advantageously made of an electrically conductive material, such as brass, to electrically interconnect one end of each string 30*a*–30*f*. The nut 27 is electrically connected to the circuit 38 via an electrical wire 44. The other end of each metallic string 30*a*–30*f* is individually connected to the electronic circuit 38 via an electrical wire 46*a*–46*f*.

The general working principle of the vibration transducing device is the amplification of the minute voltage induced in strings vibrating in a magnetic field. Indeed, the magnetic field generating bars 32, 34 and 36, which will be described in greater details hereinafter, generate a magnetic field directed towards a plane defined by the strings 30*a*–30*f*. Both ends of each string 30*a*–30*f* are connected to the electronic circuit 38 which separately amplifies the minute voltage induced in the strings. The level of this amplification by the electronic circuit 38 is such that the amplified signal has an amplitude which is sufficiently high that it may be supplied to a conventional musical instrument power amplifier (now shown) via the output jack 42 and a conventional electrical cable (not shown) suitable to interconnect a musical instrument and a power amplifier.

Figure 3:
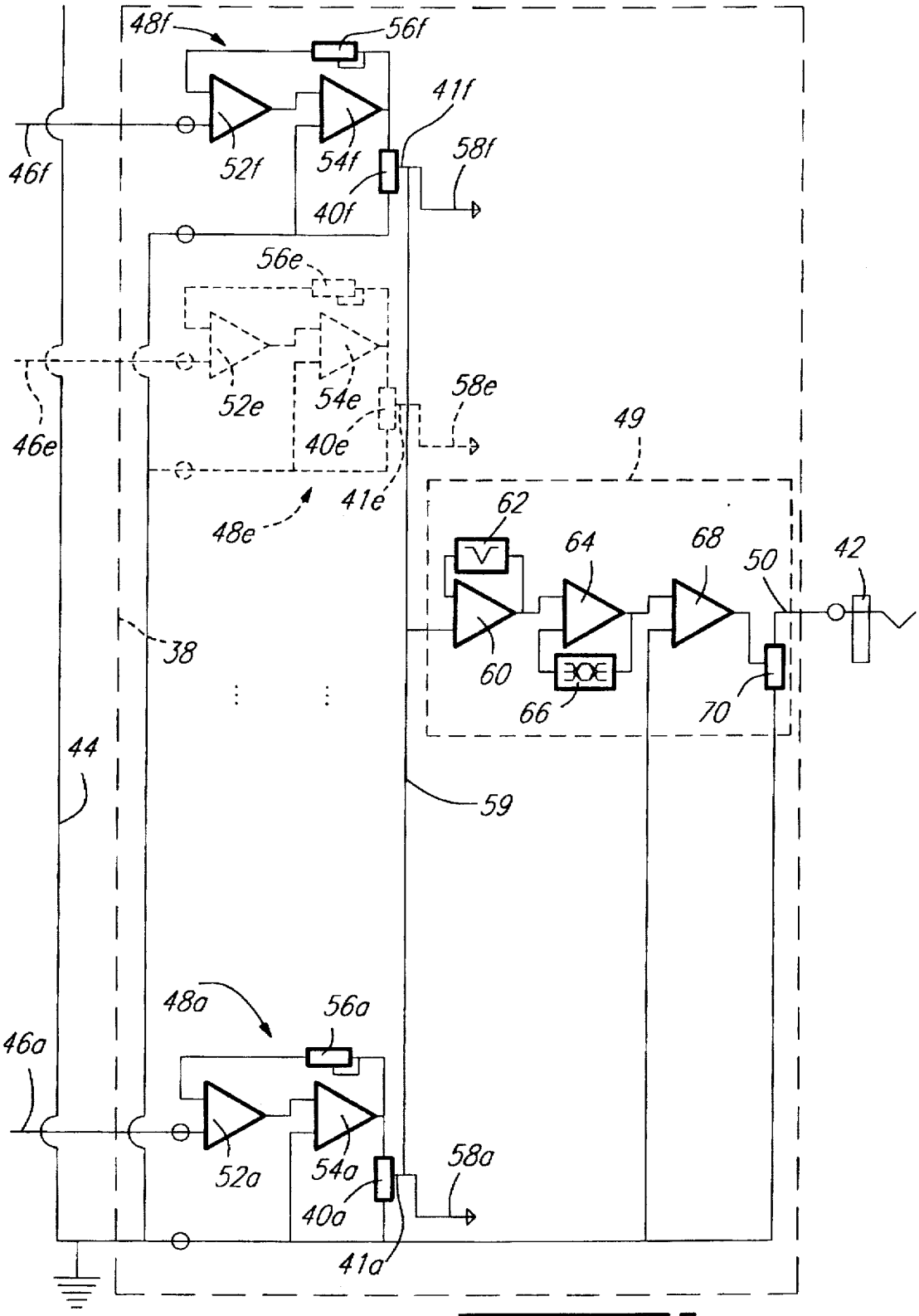
FIG. 3 is a schematic view of the amplification circuit of the vibration transducing device of FIG. 2.

FIG. 3 schematically illustrates the electronic circuit 38 in greater details. The electronic circuit 38 includes six independent and identical amplification channels 48*a*–48*f* and a common signal conditioning circuit 49.

As illustrated, each amplification channel 48*a*–48*f* is connected to a predetermined string via the electrical wire 44 and one of the electrical wire 46*a*–46*f*.

For concision purposes, and since the amplification channels 48*a*–48*f* are identical, only amplification channel 48*a* will be described hereinafter.

The amplification channel 48*a* includes a pair of amplifiers 52*a*, 54*a* which have a combined amplification gain determined by resistor 56*a*. The amplifiers 52*a*, 54*a* amplify the electric signal supplied by the electrical wire 46*a*. It has been found that amplifiers model OP-176 manufactured by Analog Devices Inc are suitable for this application.

The output of amplifier 54*a* is supplied to a potentiometer 40*a* acting as a string volume control which may be adjusted by the user of the guitar (see FIG. 1). Therefore, the volume of each string may be individually adjusted by the slide potentiometers 40*a*–40*f*.

The output 41*a* of the potentiometer 40*a* is directed to a MIDI output 58*a* allowing the guitar 12 to be directly connected to a MIDI controller (not shown).

The output 41*a* of potentiometer 40*a* is also connected to the outputs 41*b*–41*f* of the potentiometers 40*b*–40*f* of the amplification channels 48*b*–48*f* via a wire 59 to thereby sum the amplified signals coming from the wires 46*a*–46*f*. Of course, as will be easily understood by one of ordinary skills in the art, a fixed value resistor (not shown) could be required between each output 41*a*–41*f* of the potentiometers 40*a*–40*f* and the wire 59 to provide decoupling between the signals so that each potentiometer 40*a*–40*f* controls only the volume of one predetermined string.

The wire 59 is also connected to the input of the signal conditioning circuit 49 which is the input of an amplifier 60 having a notch circuit 62 in its return loop. The amplifier 60 and circuit 62 are used to filter out the 60 Hz (or 50 Hz in some countries) component of the summed signal. It has been found that amplifiers model OP-176 manufactured by Analog Devices Inc are suitable for this application. Furthermore, a rejection of about 20 dB of the 60 Hz component of the summed signal has been found suitable.

The output of the amplifier 60 is supplied to an amplifier 64 having an equalizer circuit 66 in its return loop. The amplifier 64 and equalizer circuit 66 are used to emphasise and/or to attenuate certain frequencies. It is to be noted that the equalizer circuit 66 may include control accessible to the user so that the user may adjust the characteristics of the audible sound supplied to a power amplifier (not shown). It has been found that amplifiers model OP-176 manufactured by Analog Devices Inc are suitable for this application. Furthermore, an equalizer circuit offering a control of about ±19 dB has been found suitable.

The output of the amplifier 64 is supplied to an unity gain amplifier 68 used as a buffer amplifier.

The output of the amplifier 64 is supplied to a master volume control 70 (see also FIG. 1) used to adjust the volume of the summed signals of the six strings 30*a*–30*f* simultaneously. The master volume control 70 is adjustable by the user.

The output of the master volume control 70 constitutes the output 50 of the amplification circuit and is electrically connected to the output jack 42.

Figure 4:
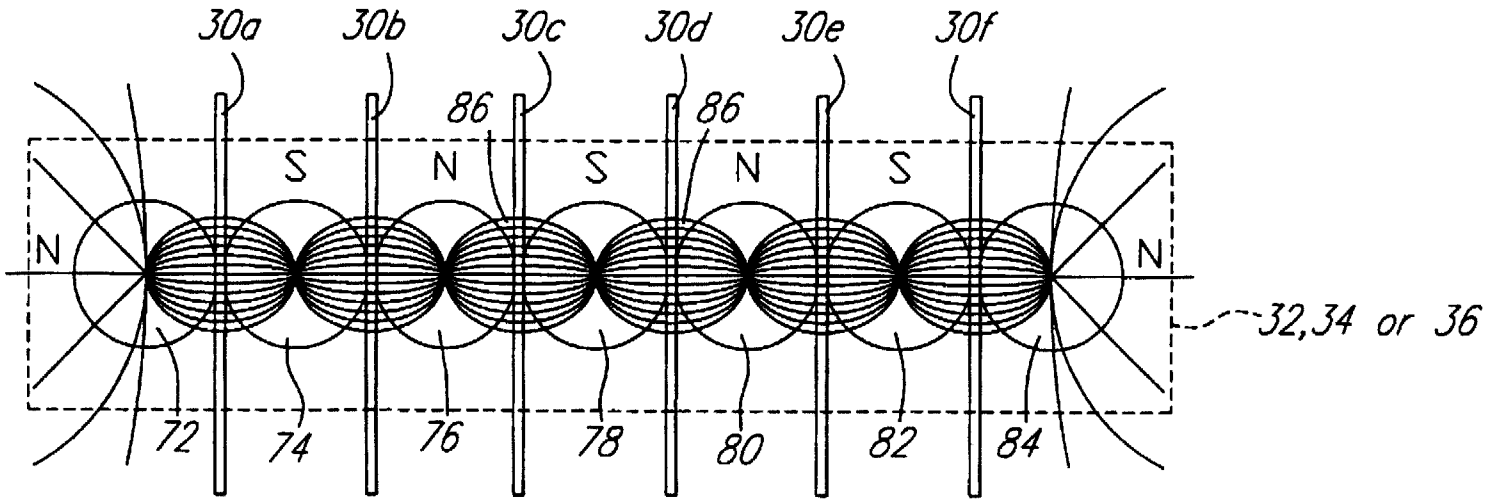
FIG. 4 is a schematic top plan view of the strings of a guitar passing over a magnetic field generating assembly.
Figure 5:
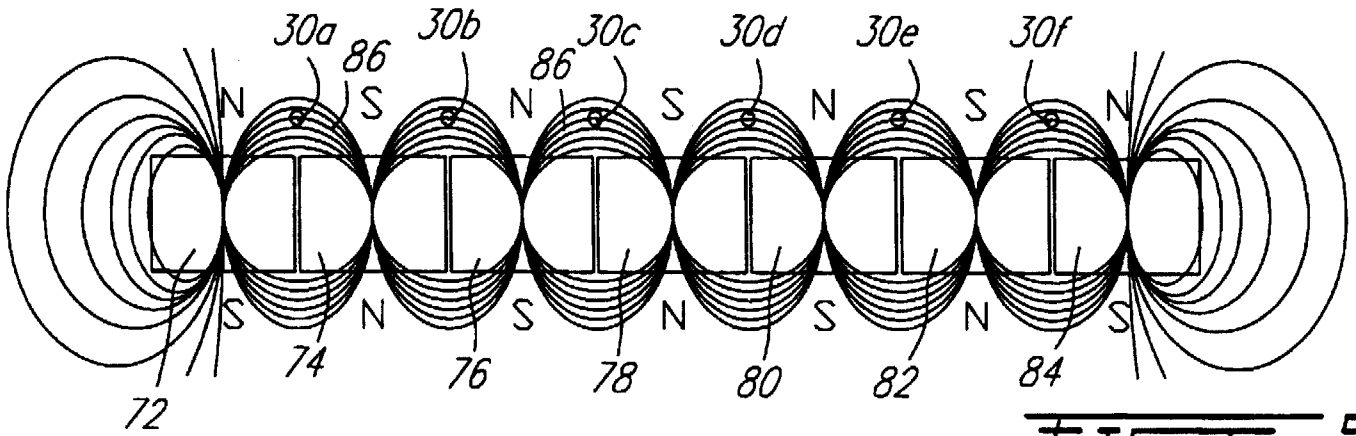
FIG. 5 is a schematic side elevational view of the strings of a guitar passing over a magnetic field generating assembly.

Turning now to FIGS. 4 and 5, the magnetic field generating bars 32, 34 and 36 will be schematically described. As illustrated, the magnetic field generating bar includes seven magnets 72, 74, 76, 78, 80, 82 and 84. The magnets 72–84 are adjacent to one another and each includes a magnetic pole which faces towards the strings 30*a*–30*f* lying in a plane. The magnetic poles of adjacent magnets being of reverse polarity. Therefore magnets 72, 76, 80 and 84 have a North pole facing the strings, and magnets 74, 78 and 82 have a South pole facing the strings. As can be better seen from FIG. 5, the magnetic poles of the magnets 72–84 and the strings 30*a*–30*f* are in a staggered relationship. Indeed, the junction between each pair of magnets corresponds to the location of one of the strings 30*a*–30*f*, and the strings and the magnets are spaced apart from one another.

In other words, as can be seen from FIG. 4, each string 30*a*–30*f* may be viewed as having a first magnet which has an offset in a first direction and a second magnet which has an offset in an opposite direction.

The magnets 72–84 generate an arcuate magnetic field made of a plurality of magnetic flux lines 86 which go from the North of one magnet to the South of the adjacent magnet or magnets. The magnetic flux lines 86 are traversed by the strings 30*a*–30*f*, therefore, if the strings vibrate, magnetic flux lines 86 will be "cut" and a minute voltage will be induced in the vibrating strings.

The pulling effect which pulls metallic strings towards conventional pick-ups is not present in the present invention since each string 30*a*–30*f* is exactly at midpoint between two reversed polarity poles of adjacent magnets. Indeed, each string 30*a*–30*f* is not pulled either way because the two poles cancel one another.

Figure 6:
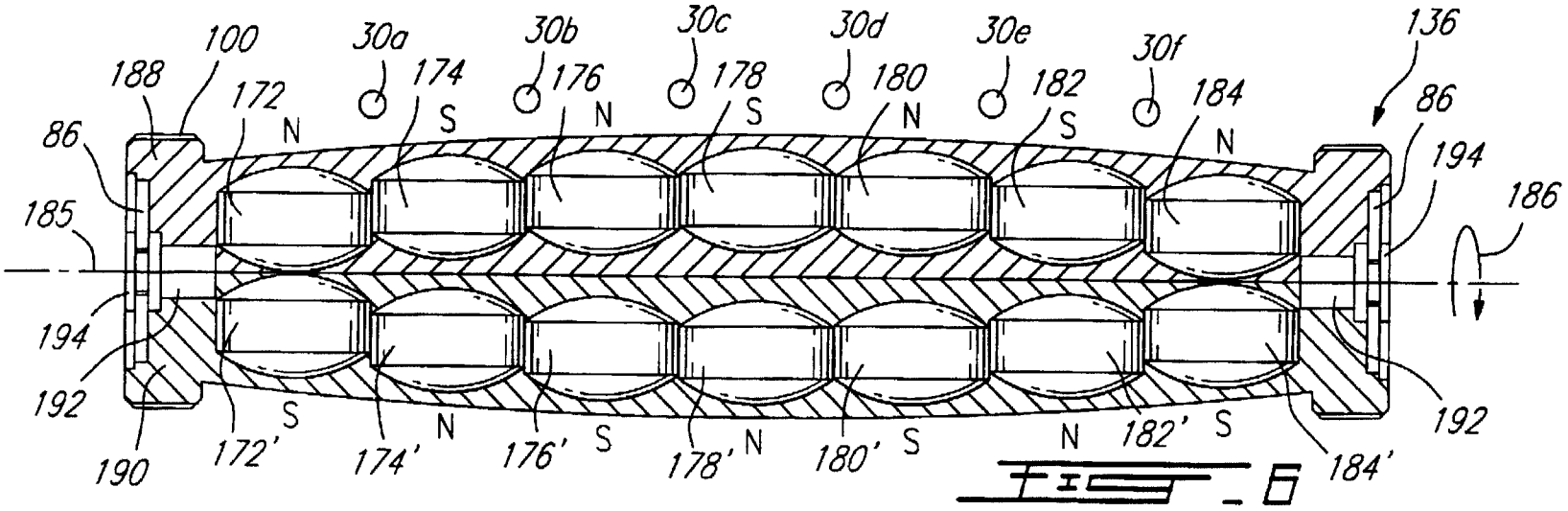
FIG. 6 is a sectional view of a magnetic field generating assembly according to a first embodiment of the present invention.

FIG. 6 illustrates a magnetic field generating bar 136 which is made of plastic material and includes a first set of seven magnets 172, 174, 176, 178, 180, 182, 184 mounted in a first portion 188 of the bar 136 and a second set of magnet 172', 174', 176', 178', 180', 182' and 184' mounted in a second portion 190 of the bar 136. The magnetic field generating bar 136 may be installed in the body 14 of the guitar 12 (FIG. 1) in substitution of the magnetic field generating bar 32, 34 and 36.

When the magnetic field generating bar 136 is in the position illustrated in FIG. 6, the first set of magnets faces the strings 30*a*–30*f* and thus a minute voltage is induced in the strings by the first set of magnets when the strings vibrate.

The magnetic field generating bar 136 may be rotated about a longitudinal axis 185, as illustrated by arrow 186, to bring the second set of magnets 172'–184' in front of the strings 30*a*–30*f*. It is to be noted that this rotation of the magnetic field generating bar 136 will reverse the polarity of the magnetic flux lines (see FIGS. 4 and 5) which are to be "cut" by the vibrating strings and therefore will modify the characteristics of the audible sound. Indeed, the polarity of the magnets of the second set is reversed with respect to the polarity of corresponding magnets of the first set of magnets.

Each longitudinal end of the magnetic field generating bar 136 includes an aperture 192 which has been countersunk so as to present an enlarged outer portion 194.

Figure 7:
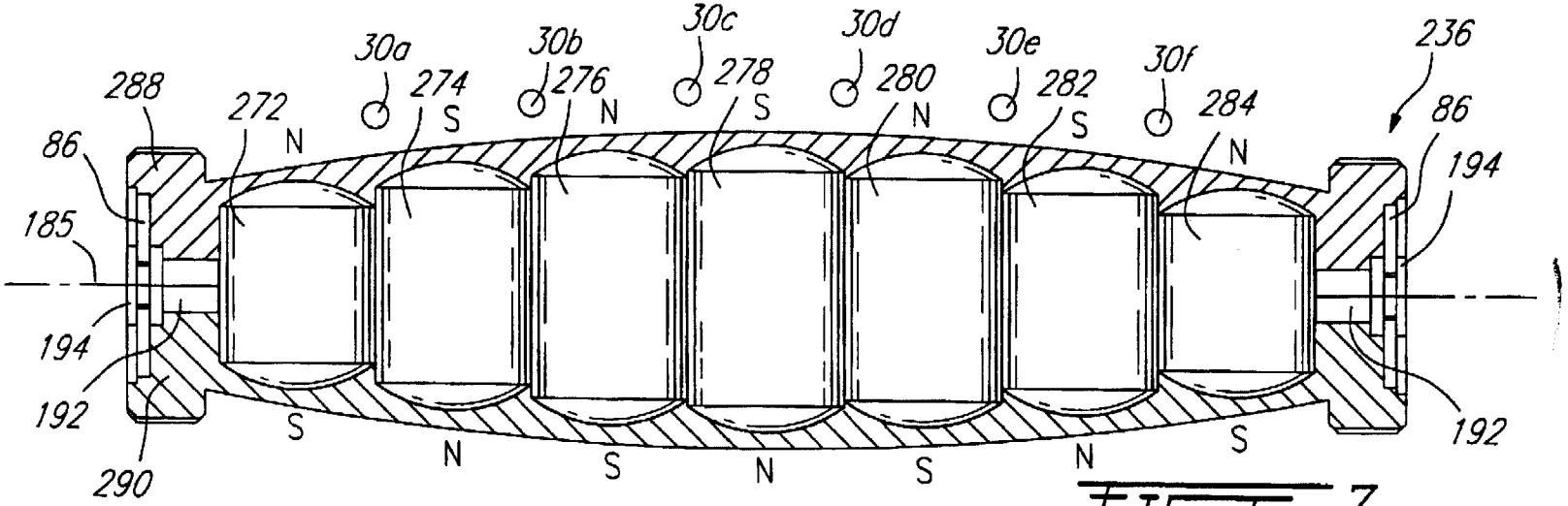
FIG. 7 is a sectional view of a magnetic field generating assembly according to a second embodiment of the present invention.

FIG. 7 illustrates another embodiment of a magnetic field generating bar 236. The major difference between bar 136 of FIG. 6 and bar 236 is that only one set of magnets 272–284 is used. However, the magnets 272–284 extend from a first portion 288 to a second portion 290 of the magnetic field generating bar 236 which enable the alternate use of both poles of the magnets 272–284 depending of the position of the magnetic field generating bar 236 with respect to the strings 30*a*–30*f*. A drawback of the magnetic field generating bar 236 is that magnets having different length must be used, which increases the cost of the magnetic field generating bar 236.

Of course, the magnetic field generating bar 236 may be installed in the body 14 of the guitar 12 (FIG. 1) in substitution of the magnetic field generating bar 32, 34 and 36.

Figure 8:
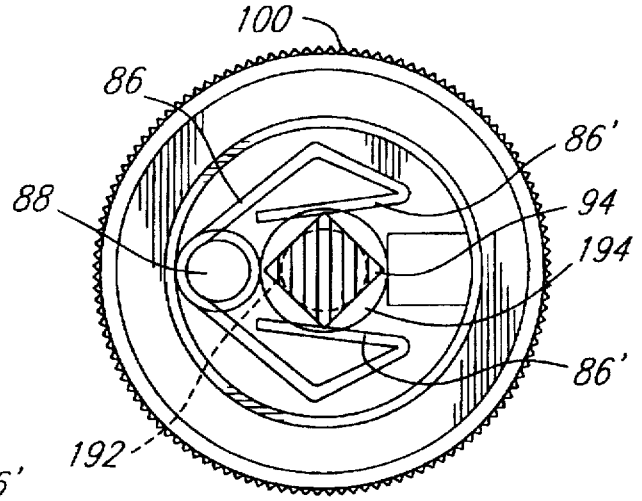
FIG. 8 is an end view of the magnetic field generating assembly of FIG. 6 or 7 illustrating a quarter-turn rotation stopping mechanism in an unstable position.
Figure 9:
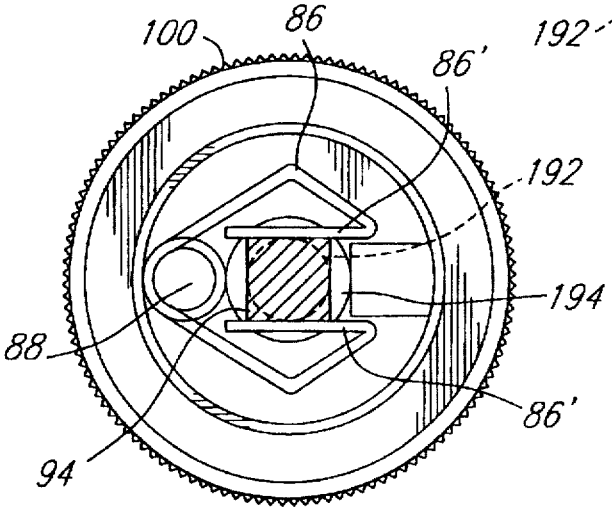
FIG. 9 is an end view similar to FIG. 8 but illustrating the quarter-turn rotation stopping mechanism of FIG. 8 in a stable position.
Figure 10:
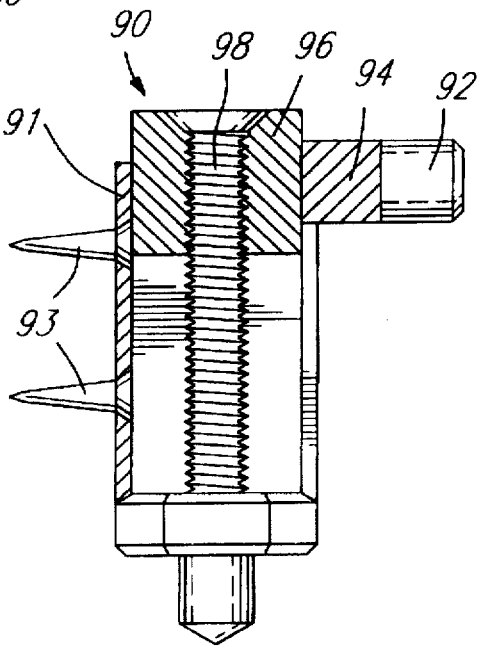
FIG. 10 is a sectional view of a magnetic field generating device raising mechanism.

Turning now to FIGS. 8–10 a magnetic field generating bar quarter turn rotation mechanism will be described. It is to be noted that the rotation mechanism is found on the magnetic field generating bar 136 of FIG. 6 and on the magnetic field generating bar 236 of FIG. 7.

The quarter-turn rotation mechanism includes a rotation stopping spring 86 provided at each end of the magnetic field generating bar and having flat portions 86'. The spring 86 is secured to a pin 88. The rotation mechanism also includes a raising device 90 (FIG. 10) including a body 91 which may be fastened in a cavity (not shown) formed in the body 14 of the guitar 12 via fasteners 93, a cylindrical pin 92 sized to enter the aperture 192, the pin 92 having a squared portion 94 sized to enter the enlarged portion 194 of the aperture 192 and a movable element 96 to which the pin 92 is mounted and which may be raised or lowered in the cavity via an endless screw 98.

In operation, when the pin 92 is inserted in the aperture 192 of the magnetic field generating bar, the squared portion 94 is in contact with the flat portions 86' of the spring 86. The magnetic field generating bar will therefore be in a stable position only when it is in one of the four positions similar to the position illustrated in FIG. 9. Indeed, when the magnetic field generating bar is in the position illustrated in FIG. 8, it is unstable and tends to go to the stable position of FIG. 9.

Therefore, to rotate one of the magnetic field generating bar of the guitar of a quarter-turn, the user only has to apply a small rotative pressure to the magnetic field generating bar to rotate it of exactly 90°. It is to be noted that ridges 100 are provided on the external surface of the ends of the magnetic field generating bars to increase the friction between the user and the magnetic field generating bar to thereby ease the rotation of the magnetic field generating bar.

The raising device 90 is used to adjust the distance between the magnetic field generating bar and the strings of the guitar 12 to thereby modify the strength of the magnetic field in the vicinity of the strings 30*a*–30*f*. Of course, as will be easily understood by one of ordinary skills in the art, the raising mechanism 90 is given as an example only since many other mechanism could be designed to achieve similar results.

Also, the guitar 12 is illustrated in the appended drawings as having three magnetic field generating bars. However, this number of magnetic field generating bar is shown for illustration purposes only.

Since the strings of a guitar are usually not strictly parallel but diverge from the nut to the bridge, the distance between the magnets change from one magnetic field generating bar to another to keep the poles of the magnets and the strings in a staggered relationship. It is however to be noted that small variations of the staggered relationship do not significantly modify the sound produced by the guitar.

It is important to note that although the vibration transducing device of the present invention is shown on an electric guitar having 6 strings, it could be modified at will for other metallic stringed musical instruments having any predetermined number N of strings. In this general case, each magnetic field generating bar would include a number N+1 of magnets facing the strings so as to generate magnetic flux lines substantially parallel to the plane formed by the strings, in the vicinity of the strings. Of course, the electronic circuit would also have a number N of amplification channels.

It is also to be noted that the magnets of the magnetic field generating bars could be permanent magnets or electromagnets. However, permanent magnets are preferred since they do not require an additional power source to generate a magnetic field.

Although the present invention has been described herein above by way of preferred embodiments thereof, it can be modified at will, without departing from the spirit and nature of the subject invention as defined in the appended claims.

What is claimed is:

1. A vibration transducer device for stringed musical instruments including a body and a predetermined number N of tensioned and electrically conductive longitudinal strings each having a first end and a second end; said tensioned longitudinal strings lying into a plane laterally adjacent to each other; said vibration transducer device comprising:

a magnetic field generating bar to be mounted to said body and including a series of N+1 adjacent magnetic field generating means each having a magnetic pole for facing said plane when said bar is mounted to said body; each said magnetic poles being of a given polarity; each pair of adjacent magnetic poles being of reverse polarities; said series of N+1 adjacent magnetic field generating means to be arranged in a staggered relationship with said N strings when said bar is mounted to said body;

an amplification circuit having a predetermined number N of amplification channels; each said amplification channel to be electrically connected to said first and second ends of a corresponding one of said strings; each said amplification channel amplifying an electric signal induced in said corresponding string by a magnetic field generated by said magnetic field generating bar, upon vibration of said corresponding string.

2. A vibration transducer device as defined in claim 1, wherein said magnetic field generating bar also includes a mounting support to be mounted to said body and to which said N+1 magnetic field generating means are mounted.

3. A vibration transducer device as defined in claim 1, wherein said magnetic field generating means are permanent magnets.

4. A vibration transducer device as defined in claim 2, wherein the mounting support includes a fixed portion and a movable portion defining first and second longitudinal surfaces, said fixed portion to be mounted to said body, said magnetic field generating means being mounted to said first surface of said movable portion; said movable portion being so mounted to said fixed portion as to be reciprocately movable from a position where the movable portion is close to said N strings to a position where the movable portion is relatively far from said strings.

5. A vibration transducer device as defined in claim 4, wherein said movable portion includes a longitudinal rotation axis; said movable portion being so mounted to said fixed portion as to be rotatable about said rotation axis so as to move said N+1 magnets away from said N strings.

6. A vibration transducer device as defined in claim 5, wherein said second surface of said movable portion includes a second series of N+1 adjacent magnetic field generating means each having a magnetic pole being of a given polarity; each pair of adjacent magnetic poles being of reverse polarities; said second series of N+1 magnetic generating field means to be arranged in a staggered relationship with said predetermined number N of strings when said movable portion is rotated about said rotation axis so that said second surface faces said plane.

7. A vibration transducer device as defined in claim 6, wherein said movable portion includes a rotation stopping mechanism to stop the rotation of the movable portion when either one of said first and second surfaces of said movable portion faces said plane.

8. An electrical musical instrument as defined in claim 7, wherein said rotation stopping mechanism includes a pivot pin mounted to said fixed portion and having a square cross-section and a stopper spring mounted in an axial cavity of said movable portion and having a pair of facing flat sections urged towards one another; said pivot pin being inserted in said axial cavity of said movable portion; said flat sections of said stopper spring contacting said square cross-section of said pivot pin.

9. An electrical musical instrument comprising:

a body having an upper bout and a lower bout;

a longitudinal neck having a proximate end and a distal end; said proximate end being attached to said upper bout of said body;

a predetermined number N of tensioned and electrically conductive longitudinal strings each having a first end mounted to said lower bout of said body and a second end mounted to said distal end of said longitudinal neck; said strings lying into a plane laterally adjacent to each other;

a string vibration transducer device including:

a magnetic field generating bar mounted to said body and including a series of N+1 adjacent magnetic field generating means each having a magnetic pole for facing said plane; each said magnetic poles being of a given polarity; each pair of adjacent magnetic poles being of reverse polarities; said series of N+1 magnetic field generating means being arranged in a staggered relationship with said N strings;

an amplification circuit mounted to said body; said amplification circuit having a predetermined number N of amplification channels; each said amplification channel being electrically connected to said first and second ends of a corresponding one of said N strings; each said amplification channel amplifying an electric signal induced in said corresponding string by a magnetic field generated by said magnetic field generating means upon vibration of said corresponding string; said amplification circuit having an output electrically connected to an output connector of said musical instrument.

10. An electrical musical instrument as defined in claim 9, wherein said magnetic field generating bar also includes a mounting support mounted to said body and to which said N+1 magnetic field generating means are mounted.

11. An electrical musical instrument as defined in claim 9, wherein said magnetic field generating means are permanent magnets.

12. An electrical musical instrument as defined in claim 10, wherein the mounting support includes a fixed portion and a movable portion defining first and second longitudinal surfaces, said fixed portion being mounted to said body, said magnetic field generating means being mounted to said first surface of said movable portion; said movable portion being so mounted to said fixed portion as to be reciprocately movable from a position where the movable portion is close to said strings to a position where the movable portion is relatively far from said strings.

13. An electrical musical instrument as defined in claim 12, wherein said movable portion includes a longitudinal rotation axis; said movable portion being so mounted to said fixed portion as to be rotatable about said rotation axis so as to move the N+1 magnets away from the N strings.

14. An electrical musical instrument as defined in claim 13, wherein said second surface of said movable portion includes a second series of N+1 adjacent magnetic field generating means each having a magnetic pole being of a given polarity; each pair of adjacent magnetic poles being of reverse polarities; said second series of N+1 magnetic generating field means being so mounted to said second surface as to be in a staggered relationship with said predetermined number N of strings when said movable portion is rotated about said rotation axis so that said second surface faces said plane.

15. An electrical musical instrument as defined in claim 14, wherein said mounting support includes a rotation stopping mechanism to stop the rotation of the movable portion when either one of said first and second surfaces of said movable portion faces the plane defined by the N strings.

16. An electrical musical instrument as defined in claim 15, wherein said rotation stopping mechanism includes a pivot pin mounted to said fixed portion and having a square cross-section and a stopper spring mounted in an axial cavity of said movable portion and having a pair of facing flat sections urged towards one another; said pivot pin being inserted in said axial cavity of said movable portion; said flat sections of said stopper spring contacting said square cross-section of said pivot pin.

* * * * *